US007194882B2

(12) United States Patent
Travis et al.

(10) Patent No.: US 7,194,882 B2
(45) **Date of Patent: *Mar. 27, 2007**

(54) COLD FORGING APPARATUS AND METHOD FOR FORMING COMPLEX ARTICLES

(76) Inventors: Ray Travis, 321 N. Lake Rd., Stevensville, MD (US) 21638; Paul Stone, 2807 Godfrey Rd., Glen Rock, PA (US) 17327

( * ) Notice: Subject to any disclaimer, the term of this patent is extended or adjusted under 35 U.S.C. 154(b) by 81 days.

This patent is subject to a terminal disclaimer.

(21) Appl. No.: 10/700,502

(22) Filed: Nov. 5, 2003

(65) Prior Publication Data

US 2004/0089048 A1 May 13, 2004

Related U.S. Application Data

(63) Continuation-in-part of application No. 10/291,361, filed on Nov. 12, 2002, now Pat. No. 6,941,782.

(51) Int. Cl.
*B21J 9/20* (2006.01)

(52) U.S. Cl. ..... 72/17.2; 72/335.6; 72/354.6

(58) Field of Classification Search ..... 72/355.6, 72/354.6, 354.8, 355.2, 355.4, 401, 403
See application file for complete search history.

(56) References Cited

U.S. PATENT DOCUMENTS 2,302,115 A * 11/1942 Gasey ..... 72/355.6
2,424,075 A * 7/1947 Brauchler ..... 72/354.6
2,513,710 A * 7/1950 Brauchler ..... 72/355.6
3,962,899 A * 6/1976 Hubbell ..... 72/334

FOREIGN PATENT DOCUMENTS

JP 5-177291 * 7/1993

* cited by examiner

*Primary Examiner*—Lowell A. Larson
*Assistant Examiner*—Debra Wolfe
(74) *Attorney, Agent, or Firm*—Dennison, Schultz & MacDonald

(57) ABSTRACT

A cold forging apparatus for forming complex shapes at a single station includes a plurality of multiple function punch assemblies disposed on intersecting axes. Each of the multiple function punch assemblies includes an inner or a center punch and an outer or ring-shaped punch surrounding and in sliding contact with the inner punch. The apparatus also includes a die holder for positioning a mass or slug of metal between the punches. A computer system controls movement of the punches and is programmable to form parts of different shapes at a single station. Off axis punches and angularly offset punches and an additional punch or punch assembly are also disclosed.

8 Claims, 8 Drawing Sheets

COLD FORGING APPARATUS AND METHOD FOR FORMING COMPLEX ARTICLES

This is a Continuation-In-Part of our earlier filed U.S. patent application Ser. No. 10/291,361 which was filed Nov. 12, 2002 now U.S. Pat. No. 6,941,782. This invention relates to cold forging apparatus and methods for forming complex articles and more particularly to cold forging apparatus for performing multiple functions at a single station and to methods for forming complex metal shapes or articles at a single station.

BACKGROUND FOR THE INVENTION

Cold forging apparatus and processes are well-known. Such apparatus and processes have been used for many years in the commercial production of relatively simple parts at a single station or more complex parts with a multi station set up. However, for more complex parts, the use of a multi station process requires duplication of equipment, additional set-up time, additional space, multiple dies and additional costs. Such costs are particularly excessive for making a limited numbers of forged parts.

More complex parts may also be forged in a machine such as an automatic forging press or cam operated cold header. In such machines, parts are transferred through a variety of stationary die sets, each of which includes a punch. Such machines are capable of operating at high speeds, but are complex, expensive and require considerable set-up time before each run. Accordingly, the use of such machines is generally limited to high volume items where the length of the run justifies the set-up time. The use of such machines is also generally limited to parts which have sufficient complexity and sufficient market value to justify the costs of the machine, set-up time and other operating costs.

It is now believed that there is a commercial market and need for a cold forging apparatus and method for forming complex articles in accordance with the present invention. The reason for such demand is that such apparatus and method offer numerous advantages. For example, the apparatus and method in accordance with the present invention are capable of cold forging complex metal shapes at a single station. Further, the apparatus and methods in accordance with the present invention requires less space and in some cases fewer operators than multiple machines each of which performs a single step in the production of a complex part. The apparatus and methods as disclosed herein also require less set-up time which enables an operator to produce shorter runs at economical costs. This is because fewer stations and less tooling results in lower production costs, particularly in those cases involving smaller volumes of parts.

A further advantage of the apparatus and method of the present invention resides in the use of multiple machines which may be slower than the aforementioned cam operated cold headers, but which provide greater flexibility and backup in the event of a machine failure or down time for a more complex machine. In addition, cold forging apparatus in accordance with the present invention can be produced and sold at a competitive price. For example, it is presently estimated that the cost of a cold forging apparatus in accordance with the present invention is less than 25% of the cost of an automatic cam operated forging press. A still further advantage resides in the use of a computer program in conjunction with multiple sets of punches at a single station. It is also believed that the apparatus in accordance with the present invention will be less complex, less expensive to install, operate and maintain and more reliable than the automatic cam operated cold headers of the prior art. Recognizing, that the prior art automatic cam operated cold headers are capable of relatively fast speeds, it is believed that the use of two, three or more machines in accordance with the present invention will be capable of matching those speeds while providing many of the aforementioned advantages including costs and added flexibility.

BRIEF SUMMARY OF THE INVENTION

In essence the present invention contemplates cold forging apparatus for performing multiple functions or steps at a single station to form a complex metal shape or part. For example, such machines are capable of drawing, upsetting and extruding at a single station using a single die and multiple punches disposed on common axis or axes. In a preferred embodiment of the invention, the cold forging apparatus includes a first multiple function punch assembly including a first inner punch and a first outer punch movable along a common axis with respect to one another. The apparatus also includes a second or intersecting confronting multiple function punch assembly including a second inner and a second outer punch movable along a common axis with respect to one another and programmable control means for separately moving the punches individually along the common axes. The apparatus also includes die positioning means for positioning and/or maintaining a die between the first and second multiple function punch assembly and for receiving and containing a mass or slug of metal to be acted on by the punches to thereby form a complex shape.

An important feature of the present invention resides in the use of a multiple ended cylinder to mount and guide the outer punch. It is important to have a multiple ended cylinder with a seal at each end so that a hole or passageway can be formed in the outer cylinder and punch assembly to allow an extension of the inner punch to pass through the center of the outer cylinder and punch. It should also be recognized that the use of a second or more multiple ended cylinders would allow for 3 or more axially nested punches for performing synchronous forming steps inside of a die.

The invention also contemplates a method for forming complex metal shapes at a single station. The method includes the steps of providing a nested punch assembly including an inner and an outer punch wherein the outer punch assembly has a double ended rod with a center passageway extending therethrough to thereby form a ring-shaped assembly. The method also includes the step of providing an extension on the inner punch which extends through the center passageway. Further, the method as contemplated by the present invention includes the steps of moving the inner and outer punches along a common axis and into the die and controlling each of the nested punches independently on a work piece within the die.

A further embodiment of the invention contemplates a first multiple function punch assembly having an inner and an outer punch for movement along a common axis for forming a mass of metal, metal blank or slug into a complex shape. However, in this embodiment of the invention, a single punch or preferably a second multiple punch assembly is constructed and arranged to act on the mass of metal, metal blank or slug at the same station as the first multiple function punch assembly. In this embodiment, the axis of the single punch or second multiple function punch assembly may be along the same axis along which the first multiple function punch assembly moves, parallel with the axis along which the first multiple function punch assembly moves but offset therefrom or angularly offset from the axis along which the first multiple function punch assembly moves.

The invention will now be described in connection with the following figures wherein like reference numerals have been used to designate like parts.

DETAILED DESCRIPTION OF THE INVENTION

Figure 1:
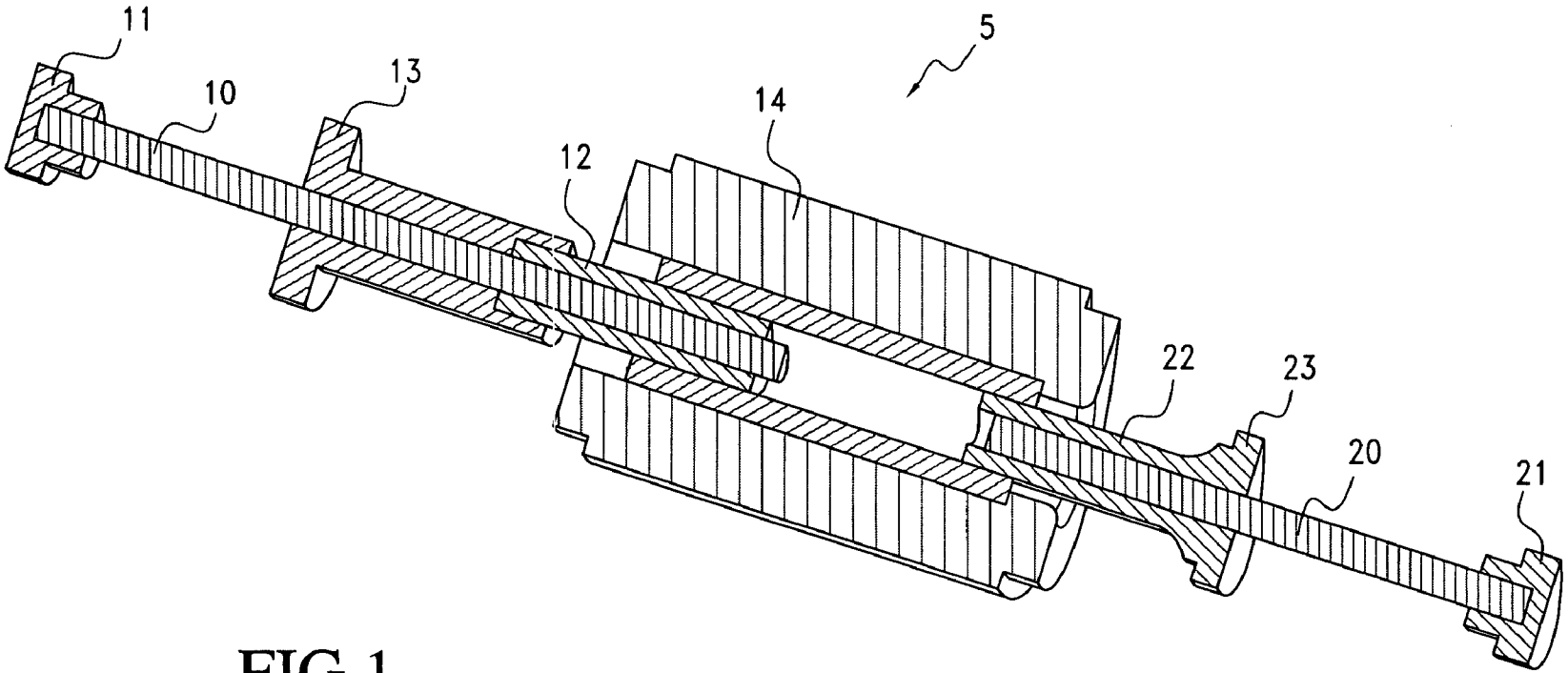
FIG. 1 is a sectional view of confronting coaxial multiple punch assemblies in accordance with a first embodiment of the invention.
Figure 2:
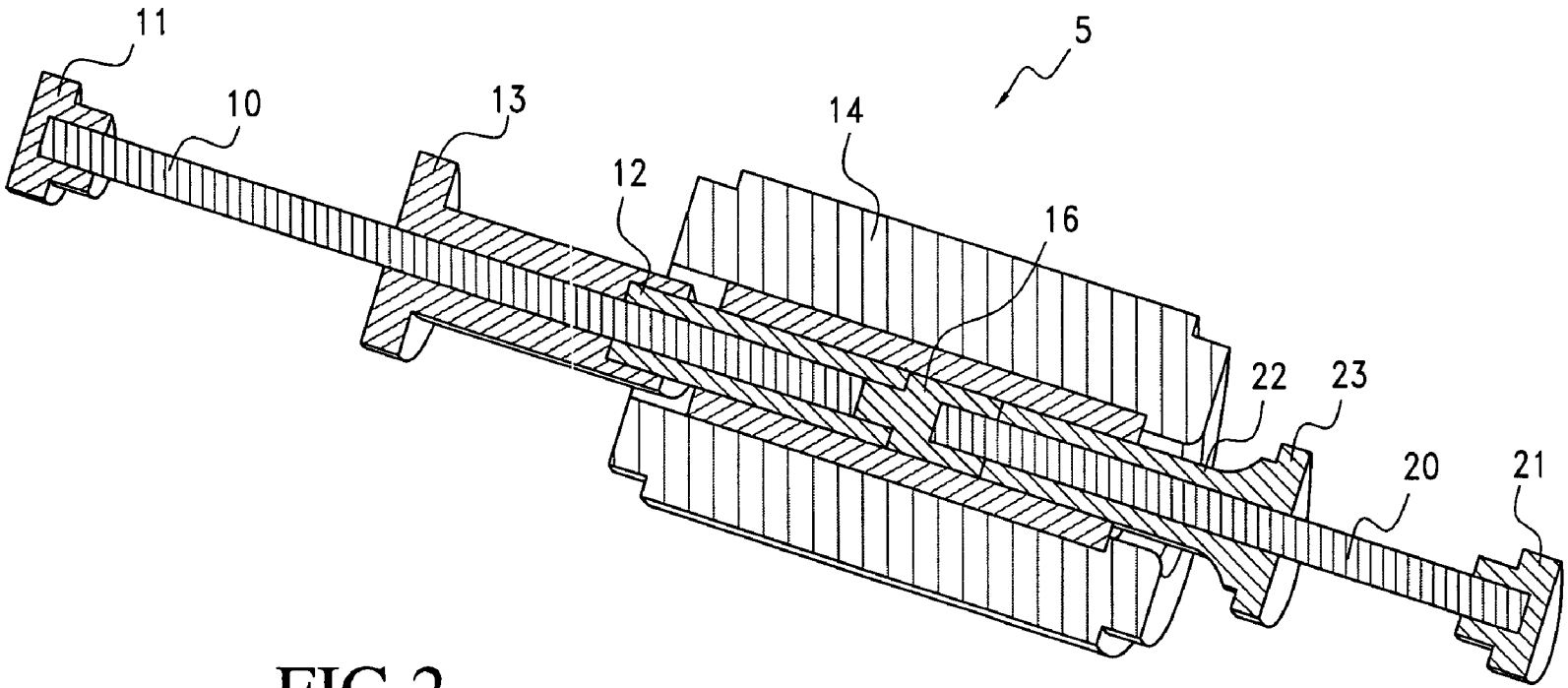
FIG. 2 is a sectional view of the multiple punch assembly as shown in FIG. 1 with the multiple punches in different positions.

FIGS. 1 and 2 illustrate a portion of a cold forging apparatus in accordance with the present invention. As illustrated, a pair of coaxial confronting multiple punch assemblies are constructed and arranged to perform multiple functions or steps at a single station. As shown, a first multiple punch assembly includes a first inner punch 10 and a first outer punch 12 disposed on a common axis in a telescopic relationship so that each of the first inner punch 10 and outer punch 12 are separately controllable and free to move independently along the common axis. The punches 10 and 12 include enlarged end portions or driving elements 11 and 13, respectively, at one end thereof for applying force to each of the punches. The opposite ends of the punches 10 and 12 are shown within a die 14.

The second multiple punch assembly is similar to the first multiple punch assembly and includes a second inner or central punch 20 and a second outer punch 22 disposed on a common axis in a telescoping relationship. The punches 20 and 22 are like the punches 10 and 12 separately controllable and free to move independently along the common axis. The punches 20 and 22 also include enlarged end portions or driving elements 21 and 23, respectively, at one end thereof for applying force to each of the punches. The opposite ends of the punches 20 and 22 are shown within a die 14.

Figure 3A:
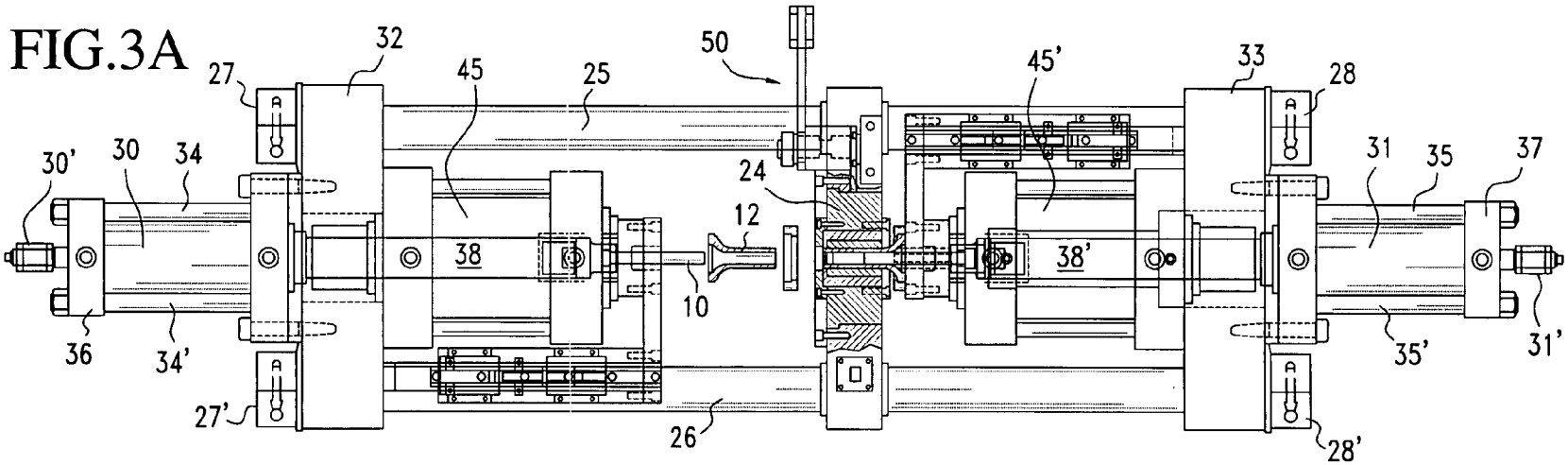
FIG. 3A is a top or plan view of the cold forging apparatus according to one embodiment of the invention.
Figure 3B:
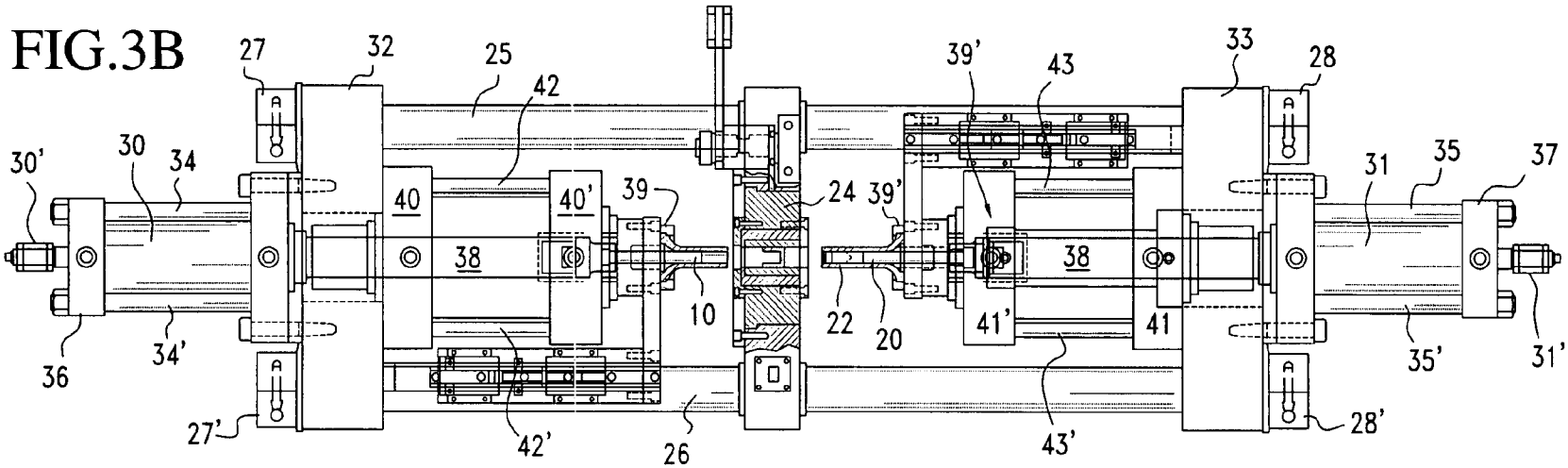
FIG. 3B is a top or plan view of the cold forging apparatus as shown in FIG. 3A with the outer punch fixed to a press and with a forged part within a die.

A cold forging apparatus in accordance with one embodiment of the invention is illustrated in FIGS. 3A and 3B wherein a central platen or die carrier 24 is shown in different positions. The apparatus includes a tie bolt assembly including two bolster plates 32 and 33 which are tied together by four bars or rods 25 and 26 (only two shown) and held together in a conventional manner as indicated by nuts 27, 27', 28 and 28'. A loader/unloader mechanism 50 may also be mounted on the die carrier 24 for automatic or semiautomatic loading of the die 14 by moving a metal slug or blank from a loading area to a position between the punches. A conventional mechanism for loading and/or unloading a blank or part will be described in more detail hereinafter with respect to FIG. 5.

The apparatus also includes hydraulic cylinders 30 and 31 which are outside of the press frame at opposite ends thereof and which are held to the bolster plates 32 and 33 by the bolts 34, 34', 35 and 35', end caps 36 and 37 and a plurality of nuts in a conventional manner. Each of the hydraulic cylinders 30 and 31 is connected to a source of hydraulic pressure (not shown) by connectors 30' and 31'.

The cylinders 30 and 31 drive cylinder rods 38 and 38' along a common axis. The cylinder rods 38 and 38' are connected to the center or inner punch 10 and 20, respectively, by any suitable connectors 39, 39'. The apparatus also includes a pair of cylinders 45, 45' which are disposed within the press frame. These cylinder assemblies include forward and rear end caps 40, 41, forward end caps 40', 41' and tie rods 42, 42', 43 and 43'. The cylinders 45 and 45' are each connected to separate sources of hydraulic pressure (not shown) in a conventional manner. The cylinders 45, 45' also include a center passageway or hole through which the cylinder rods 38 and 38' pass.

The cylinders 45, 45' each comprise a multi-ended cylinder assembly preferably a double ended rod assembly with a seal at each end and a hole or passageway drilled through the center of the rod. This hole or passageway allows the extension or rods 38 and 38' to pass through the center of the rods. It is also contemplated that a second and third multi-ended cylinder rod could be used to allow for 3 or more axially nested punches for performing synchronous forming steps inside of a die.

Figure 4B:
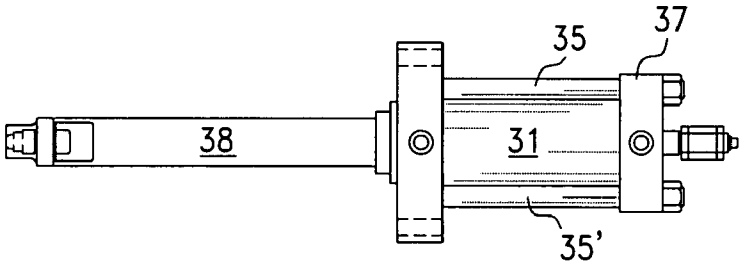
FIG. 4B is a top or plan view of an extended rod for use in practicing the present invention.
Figure 4A:
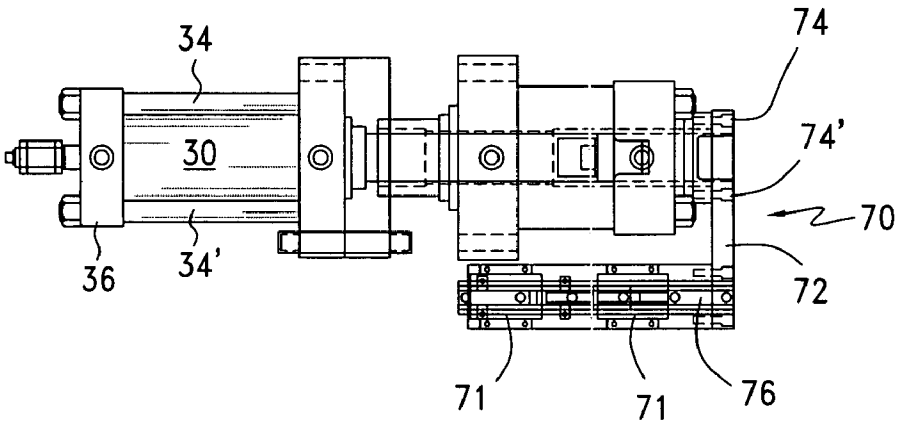
FIG. 4A is a top view of nested hydraulic cylinders of the type used in the cold forging apparatus in accordance with the invention.

The cylinders 30 shown in FIGS. 4A and 4B are of a conventional design. For example, the hydraulic cylinder or presses can be purchased from Miller Fluid Power of Bensenville, Ill. and identified as model H-67B. As shown more clearly in FIG. 4B, an extension rod 38' is operably connected to the cylinder 30 for passing through the cylinder 45'. The cylinder 45' is also of a conventional design, but has been modified by forming a passageway or drilling a hole through the center of the rod to form a tube shaped rod which is internally supported or guided by conventional bronze bearings. The basic cylinder 45 includes a ring-shaped punch. The basic cylinder is available from Miller Fluid Power as a double ended press, Model No. DH 67B.

As shown in FIG. 4A, the apparatus in accordance with the present invention also includes an anti-rotation mechanism 70. The anti-rotation mechanism includes a pair of carriages 71, 71' and arm 72 which is connected to the carriages 71, 71' in a conventional manner at one end thereof. An opposite end 73 of the arm 72 is bolted to the outer or ring-shaped cylinder rod by a pair of bolts 74 and 74'. The carriages 71, 71' move forward and back along a rail 76 with movement of the ring-shaped cylinder rod and prevents the ring-shaped cylinder rod from rotating inside the cylinder. The anti-rotation mechanism is important when the nested punches must be aligned with the die cavity for complex nested profiles, as for example introducing a part with gear teeth or the like.

Figure 5:
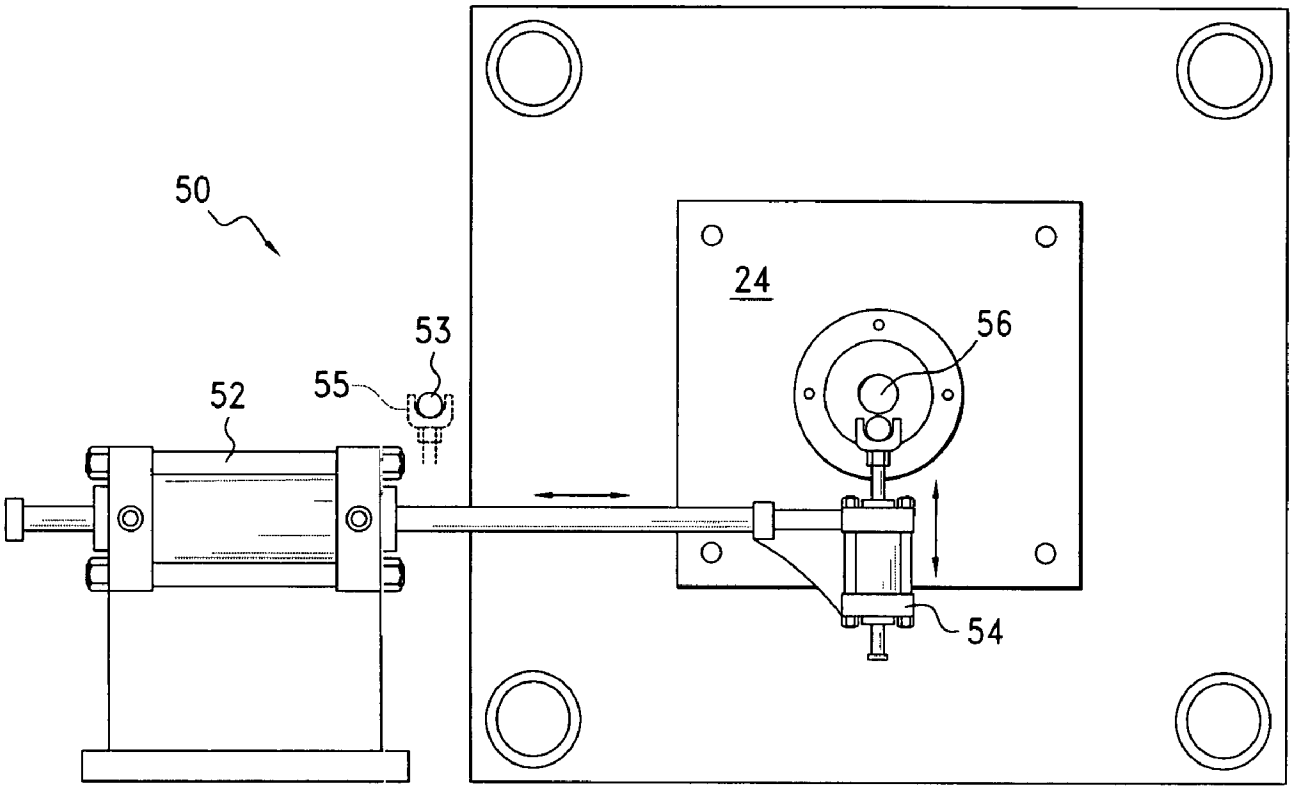
FIG. 5 is a schematic illustration of a conventional loader for use in connection with the present invention.

As illustrated in FIG. 5, a loader 50 may be of a conventional design and may be adjacent to the die carrier 24 or positioned thereon. The loader/unloader 50 includes a pair of air cylinders 52 and 54 for positioning a load blank 53 in front of a die 56. The first cylinder 52 moves a load carrier 55 horizontally from a first position into alignment with the die 56. The second air cylinder 54 then positions the load blank 53 in front of the die where it is delivered into the die 56 by one of the punches. The carrier 55 is then returned to a first position in a conventional manner.

Figure 6:
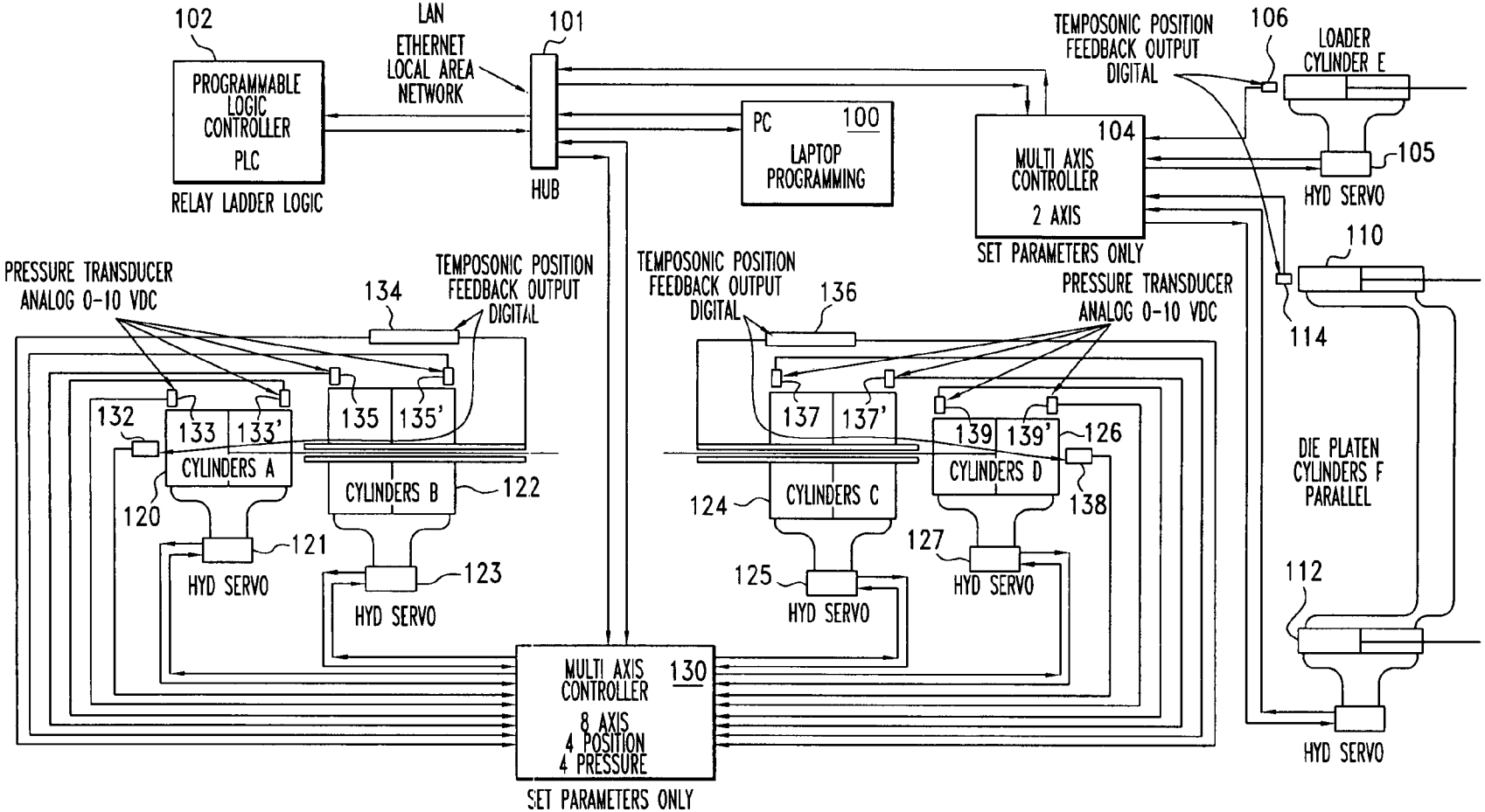
FIG. 6 is a schematic illustration of the control logic for controlling the apparatus in accordance with the present invention.

The operation of the cold forging apparatus disclosed herein is illustrated in FIG. 6. As shown therein, a personal computer 100 such as a laptop is used for programming the programmable logic controller 102 and/or controlling the movement of the punches 10, 12, 20 and 22 (shown in FIGS. 1 and 2) for forming a part having a preselected shape. The computer 100 is operatively connected to a programmable logic control 102 by means of an ethernet local area network (LAN) 101. The LAN 101 is operatively connected to a first multi axis controller 104 which controls a shuttle or other type loader 50. The loader then loads and/or receives a metal slug or a finished part in response to the data from the multi-axis controller. A Tempasonic position feedback output digital device 106 is also operatively connected to multi access controller 104 and feeds back data on the status of the loader 50.

The multi access controller 104 which is operatively connected to a hydraulic servo 105 to control movement of a pair of parallel die platen pistons in die platen cylinders 110 and 112. A second Tempasonic position feedback output device 114 is operably connected to the multi access controller 104 to convey feedback data to the controller 104.

The movement of the four punches 10, 12, 20 and 22 (FIGS. 1 and 2) are actuated by hydraulic cylinders 120, 122, 124 and 126 which are operable by means of hydraulic servos 121, 123, 125 and 127, respectively, in response to data or signals from a second multi access controller 130. The second multi access controller 130 is operably connected to the LAN 101 and is effective in controlling eight parameters i.e., four position and four pressure sensors, one each for each of the punches 10, 12, 20 and 22. The second multi access controller 130 receives data corresponding to the positions of the cylinders or pressures on each of the punches from Tempasonic digital position feedback devices 132, 134, 136 and 138, respectively, and pressure from pressure transducers 133, 135, 137, 139, 133', 135', 137', and 139'. Two pressure transducers are provided for each of the four cylinders with one on each side of the pistons.

The data from the Tempasonic feedback devices 132, 134, 136 and 138, and pressure transducers 133, 135, 137, 139, 133', 135', 137' and 139' is transmitted to the programmable logic controller 102 by means of the LAN 101. The Tempasonic feedback devices and pressure transducers are conventional in design and are available from Miller Fluid Power of Bensenville, Ill.

Programming the movement of each of the punches is effective in producing complex shapes within a single die and also for changing the shapes of the forged parts to be formed. Such programs are well within the skill of a programmer with experience in forging parts based on the diagram as shown in FIG. 6.

Figure 7:
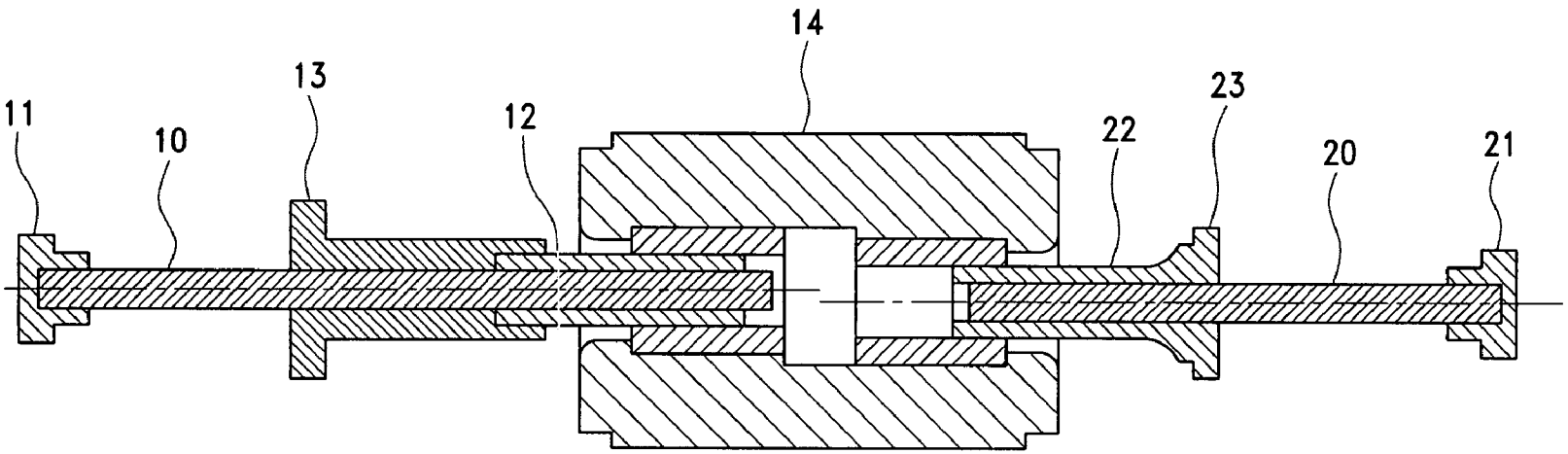
FIG. 7 is a sectional view of a plurality of multiple function punch assemblies wherein the axes of the multiple function punch assemblies are offset from one another.

As illustrated in FIG. 7, a pair of coaxial multiple punch assemblies are disposed in a generally confronting arrangement for acting on a single work piece at a single station. Each of the punch assemblies include a first inner punch 10 and a first inner punch 12 axis in a telescopic relationship so that each of the first inner punch 10 and first outer punch 12 are separately controllable and free to move independently along the common axis. The punches 10 and 12 include enlarged end portions are driving elements 11 and 13, respectively at one end thereof for applying force to each of the punches. The opposite ends of the punches 10 and 12 are shown within a 14.

The second multiple punch assembly is similar to the first multiple punch assembly and includes a second inner or central punch 20 and a second outer punch 22 disposed on a common axis in a telescoping relationship. The punches 20 and 22 are, like the punches 10 and 12, separately controllable and free to move independently along their common axis. The punches 20 and 22 also include enlarged end portions of the driving elements 21 and 23 respectively, at one end thereof for applying force to each of the punches. The opposite ends of the punches 20 and 22 are shown within a die. Unlike FIG. 1, the punch assemblies including 10 and 12 are disposed on a first axis while the punches 20 and 22 are disposed along a separate axis. As illustrated, the axes are parallel but linearly offset from one another.

Figure 8:
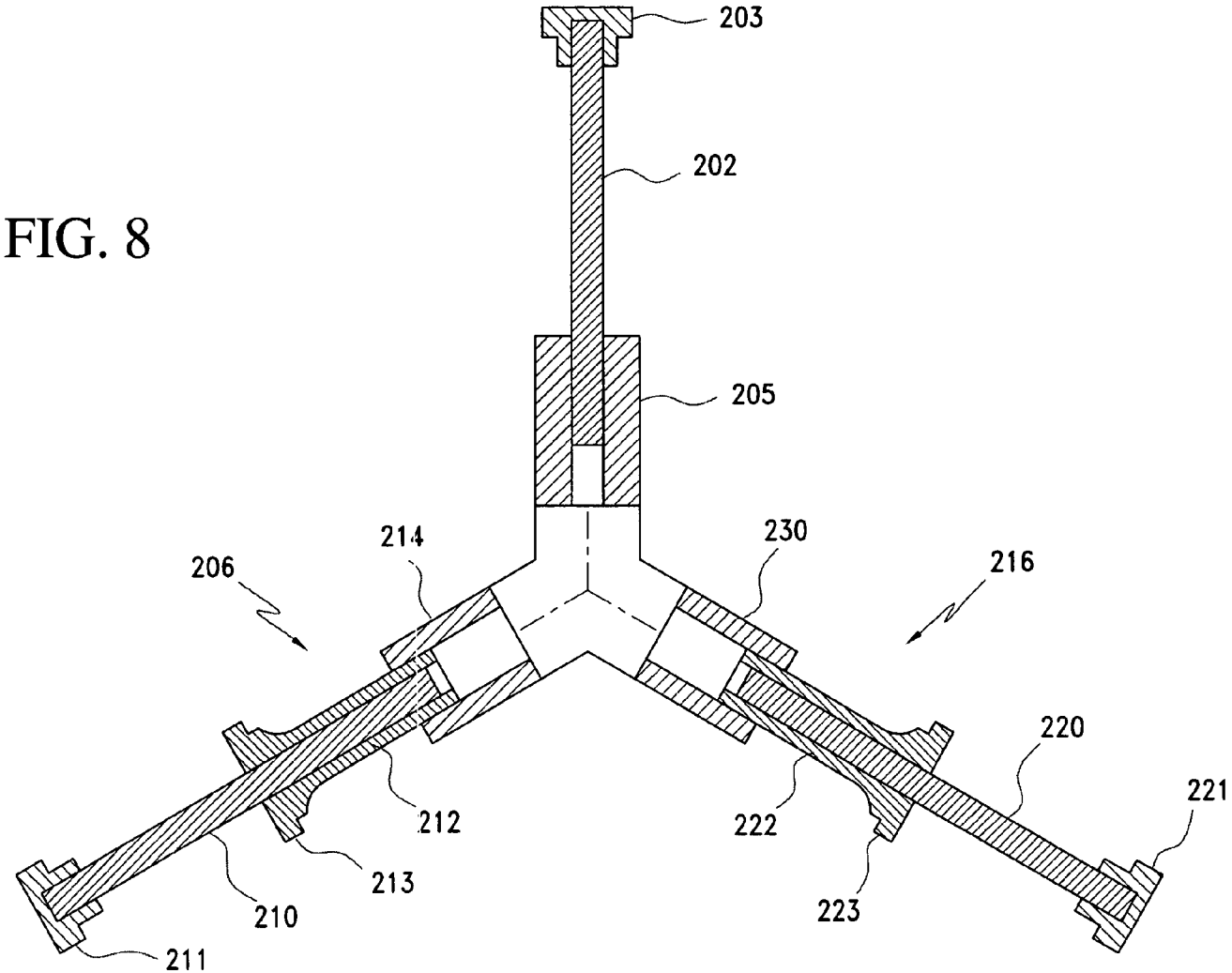
FIG. 8 is a sectional view of a plurality of multiple function punch assemblies wherein a third multiple function punch assembly moves along an axis which intersects the axis of the first and second multiple function punch assemblies.

A further embodiment of the invention is illustrated in FIG. 8. As illustrated therein, a first single punch 202 is disposed on a generally vertical axis and includes an enlarged end portion where driving element 203 at one end thereof for applying force to the punch. An opposite end of the punch is shown within a die 205.

A first multiple punch assembly 206 includes a first inner punch 210 at a first outer punch 212 disposed on a common axis which is angularly offset from the axis of the first single punch but intersects therewith. The first inner punch includes an enlarged end portion or driving element 211 for applying force to the punch. The first outer punch 212 also includes an enlarged end portion 213 for the same purpose. The opposite ends of the punches 210 and 212 as illustrated are disposed in a die 214. As illustrated, the intersecting axis of the first single punch and first multiple punch assembly 206 are angularly offset by about 120° C., but other angular offsets could be changed to produce custom parts having a shape which dictates such angles. It is also contemplated that a four punch arrangement with two pair of confronting punches each punch being angularly offset from adjacent punch by about 90° C.

A second multiple punch assembly 216 includes a second inner or central punch 220 and a second outer punch 222 disposed on a common axis in a telescoping relationship. The punches 220 and 222 each include enlarged end portions 221 and 223 with opposite ends disposed in a die 230.

While the invention has been described in connection with its preferred embodiment, it should be recognized that changes and modifications may be made therein without departing from the scope of the claims.

What is claimed is:

1. A cold forging apparatus for performing multiple functions at a single station to form complex shapes, said apparatus comprising:

a first multiple function punch assembly including a first inner punch and a first outer punch moveable along a common axis with respect to one another;

a third moveable punch moveable along a second axis;

means for moving said punches individually along said axes;

means for positioning a die for receiving a mass of metal and for action upon said mass of metal in response to movement of said punches to thereby form a complex shape at a single station, and a programmable logic controller, a multi-axis controller, and feedback devices including a position sensor for each of said first inner and outer punches, and means for controlling movement of said first inner and outer punches individually along said common axis in response to the sensed position of said first inner and outer punches to thereby form a complex shape.

2. A cold forging apparatus for performing multiple functions at a single station to form complex shapes according to claim 1 in which said axes are parallel but linearly offset from one another whereby said first inner and outer punches impact on one portion of a metal mass and said third punch impacts on another portion of the metal mass.

3. A cold forging apparatus for performing multiple functions at a single station to form complex shapes according to claim 1 in which said common axis and said axis of said third punch are angularly offset from one another but constructed and arranged so that each of said punches impact on a mass of metal at a single station.

4. A cold forging apparatus for performing multiple functions at a single station to form complex shapes according to claim 1 in which said third punch is a second multiple function punch assembly including a second inner punch and a second outer punch moveable along a common axis.

5. A cold forging apparatus for performing multiple functions at a single station to form complex shapes according to claim 4 in which said second multiple function punch assembly is in a generally confronting relationship with said first multiple function punch assembly.

6. A cold forging apparatus for performing multiple functions at a single station to form complex shapes according to claim 5 in which said first and said second punch assemblies are disposed on a common axis and adapted to impact on opposite sides of said mass of metal.

7. A cold forging apparatus for performing multiple functions at a single station to form complex shapes according to claim 1 which includes an additional punch moveable along an axis so that said additional punch impacts on a different portion of the mass of metal.

8. A cold forging apparatus for performing multiple functions at a single station to form complex shapes according to claim 7 in which said additional punch is a multi functional punch assembly including a third inner punch and a third outer punch moveable along a common axis with respect to one another.

* * * * *